United States Patent [19]

Marcus

[11] 4,111,413

[45] Sep. 5, 1978

[54] GAME IN THE FORM OF A MINIATURE MINE CONTAINING A PRECIOUS GEM

[76] Inventor: Emanuel J. Marcus, 8120 SW. 151st St., Miami, Fla. 33158

[21] Appl. No.: 778,962

[22] Filed: Mar. 18, 1977

[51] Int. Cl.[2] ..... A63F 9/06

[52] U.S. Cl. ..... 272/1 R; 46/1 R; 206/45.31; 206/45.34

[58] Field of Search ..... 273/139, 1 R; 272/1 R; 206/45.31, 45.34, 521, 588, 591, 592; 229/14 C; 220/82 A; 46/11, 1 R

[56] References Cited

U.S. PATENT DOCUMENTS

| | | | |
|---|---|---|---|
| 1,982,390 | 11/1934 | Lewis | 206/45.31 |
| 2,123,501 | 7/1938 | Cunninghame | 206/45.31 X |
| 2,144,336 | 1/1939 | Katz | 206/45.34 X |
| 2,330,347 | 9/1943 | Elliott | 206/591 X |
| 2,790,588 | 4/1957 | Deeren | 229/14 C |
| 2,807,404 | 9/1957 | Cote | 206/45.31 X |
| 3,311,226 | 3/1967 | Oliver | 273/1 R X |

FOREIGN PATENT DOCUMENTS

| | | | |
|---|---|---|---|
| 245,472 | 2/1966 | Australia | 206/45.34 |
| 402,267 | 2/1943 | Italy | 206/45.31 |
| 1,224,493 | 10/1971 | United Kingdom | 229/14 C |
| 845,561 | 8/1960 | United Kingdom | 206/45.34 |

*Primary Examiner*—Richard C. Pinkham
*Assistant Examiner*—Arnold W. Kramer
*Attorney, Agent, or Firm*—Strauch, Nolan, Neale, Nies & Kurz

[57] ABSTRACT

A game including a box of granular material to simulate a mine, within which is hidden a precious gem, such as a diamond. The box is transparent and is securely packaged in an open-sided carton, for display of the box and its contents. The box may include a smaller transparent specimen box inside the lid of which has an integral magnifying glass. The object of the game is to sieve the granular material until the genuine, ¼ carat diamond is found. A pendant and chain may be provided, in which the diamond may be mounted to form a completed piece of jewelry which may be worn.

6 Claims, 5 Drawing Figures

GAME IN THE FORM OF A MINIATURE MINE CONTAINING A PRECIOUS GEM

BACKGROUND OF INVENTION

Games having the discovery of a hidden thing or person as their ultimate goal are as old as history, e.g., hide-and-go-seek. The present invention constitutes a variation on this age old theme by providing a container of granular material within which is hidden a small but nevertheless genuine ¼ carat diamond. Equally importantly, the game imparts an appreciation of both the difficulty of discovery of real diamonds as well as an understanding of the nature and appearance of a rough, uncut diamond, especially when compared with the more familiar diamond of gem-like quality.

Prior U.S. Pat. No. 3,960,377 issued to Doyle teaches a simple game apparatus including an open box of sand or similar granular material within which are hidden a number of game pieces in the shape of elongate members having looped, distal ends. The object of the game is to retrieve the members with the aid of a hook.

In contradistinction thereto the instant game apparatus is partially recreational and partially educational in nature. It is intended for solo participation but may be enjoyed by two or more persons simultaneously, if desired. It is uniquely packaged so as to be attractively displayed for a relatively low cost. The individual components of the invention are mostly available shelf items, thus further reducing manufacturing costs. The ultimate object of the game is to carefully sieve the sand, reducing the granular material to a smaller collection of larger diameter stones and carefully explore this remainder until the single, uncut diamond is found.

SUMMARY OF THE INVENTION

Accordingly, it is a principal object of the invention to provide a game in the nature of a miniature mine comprising a quantity of granular material within which is hidden a single, uncut diamond.

It is another object of the invention to provide a miniature mine game uniquely packaged for attractive display as well as for ease of packaging, shipping and storing.

It is a further object of the invention to provide a miniature mine game that is simultaneously recreational and educational in nature.

The invention includes a cardboard or like material cube shaped container having opposed, apertured sides, a smaller, cube shaped transparent box fitted within the cardboard container and containing a quantity of granular material, within which the precious gem or diamond is concealed, and a pair of packaging blocks fitted at the top and bottom of the cardboard container, for retaining the transparent box disposed at an angular attitude within the container. Additionally, a specimen box for displaying the gem having a top with an integral magnifying glass to assist in finding the gem is provided; it may be located within the granular material housed in the transparent box. A necklace and pendant may be provided for mounting the diamond so that it may be worn as jewelry.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which.

DESCRIPTION OF THE PREFERRED EMBODIMENT

Figure 1:
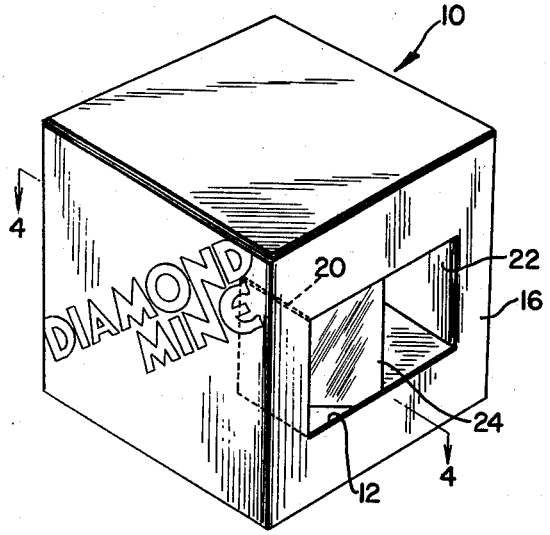
FIG. 1 is a perspective view of the invention completely packaged.

A cube-shaped cardboard container 10 is apertured at 12, 14 on opposed sides 16, 18, respectively. Apertures 12, 14 are easily formed merely by cutting through otherwise conventional container walls in "I" shaped fashion and thereafter folding portions 20, 22 of each aperture 12, 14, respectively, inwardly of the container 10.

A smaller dimensional cube shaped transparent box 24 comprises the actual "mine"; details of construction and function will be discussed below.

Figure 2:
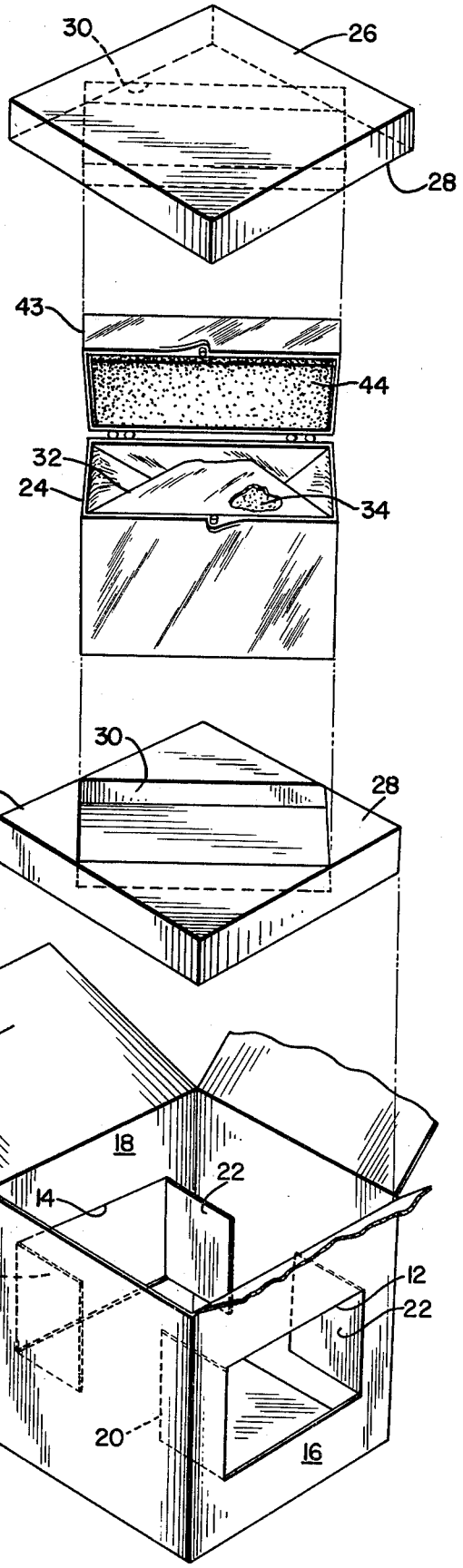
FIG. 2 is an exploded perspective view, showing most of the constituent parts of the invention.

Box 24 is sandwiched between a pair of pillow blocks 26, 26, each made of suitable material such as styrofoam. The lateral dimensions of each block 26 conform to those of the interior of container 10 while the surfaces 28 thereof are recessed at 30 to conform to the external dimensions of box 24. It should be noted here that, in the preferred embodiment, box 24 is oriented angularly with respect to its nested position within container 10, by being rotated 45° about a central vertical axis so that a diagonal of its top or bottom is aligned parallel to two of the sides of either pillow block 26 or container 10. The orientation being discussed is clearly illustrated by noting the orientation of recess 30 within a pillow block 26 in FIG. 2.

Figure 4:
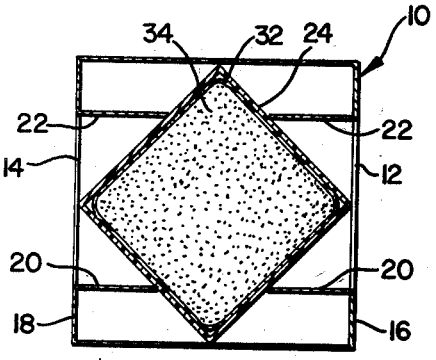
FIG. 4 is a section view taken along lines 4—4 of FIG. 1.

Thus, when the entire assembly is packaged as shown in FIG. 1, box 24 is attractively displayed within container 10, with folded cutout portions 20, 22 retained open by box 24 (FIG. 4) so that its contents may be seen by a prospective purchaser.

Figure 3:
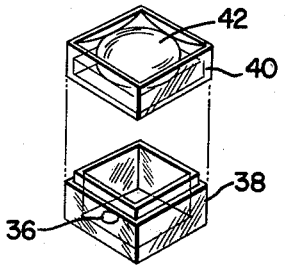
FIG. 3 is a perspective view of the specimen box portion of the invention.

Turning now to a discussion of box 24 and its contents, a clear plastic bag 32 holds a quantity of granular material 34 ranging in size from sand like consistency up to small stones on the order of ⅛ inch in diameter or so. Most importantly, a single uncut diamond 36 (FIG. 3) having a weight of about ¼ carat, thus also being about ⅛ inch or so in diameter, is hidden within granular material 34 to be discovered by a rather careful process which will be discussed hereinbelow.

Also enmeshed within granular material 34 is a specimen box 38 (FIG. 3), which may be made of clear plastic, and which has a top 40 with a magnifying glass 42 formed integrally therein which is useful in searching through granular material 34 to find diamond 36. Alternatively, specimen box 38 may be packaged separately from box 24, within container 10 (not shown).

Box 24 also has a hinged cover or top 43 which may further include a sponge liner 44 to reduce shifting of granular material 34 during shipment and handling.

The search for the diamond 36 in granular material 34 proceeds as follows. Box 24 is removed from container 10, opened, and specimen box 38 is removed for later use. Then, bag 32 with its contents is removed. With the aid of a large frying pan and a wire mesh food strainer or tea strainer (not shown) granular material 34 is carefully poured through the strainer from bag 32, into the frying pan. The strainer is jiggled slightly to assure that all the fine diameter sand falls through to the frying pan so that only the larger diameter particles remain in the strainer. However, the material in the frying pan is not discarded, but is retained, just in case the gem or diamond fell through the strainer.

Next, the strainer contents are carefully poured into a shallow bowl or dish (not shown) or, perhaps, several sheets of paper, and the stones are carefully spread apart and examined. A brochure is provided with the invention (not shown) which has pictures of the appearance of similar gems or diamonds. The box top 40 with its magnifying glass 42 may be enlisted for the search.

In the case of diamond, a suspicious stone may be given a scratch test with a needle or pin by carefully securing the stone and rubbing the point of the needle or pin across the surface of the stone; if a scratch is observed, then the suspect stone is not a diamond.

Figure 5:
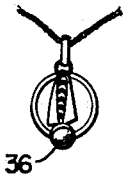
FIG. 5 is a partial elevation view of a necklace and pendant to which the diamond may be attached after it is found to make a useful piece of jewelry.

After the diamond 36 is found, it may be displayed in specimen box 38. Alternatively, a chain and pendant (FIG. 5) may be provided to which the diamond 36 may be glued, as by epoxy cement. Thereafter, the completed necklace may be worn as jewelry. The chain and pendant may be packaged in specimen box 38 initially.

The search may take some time and gives one some appreciation of both the difficulty of sorting diamond from other stones with which it is ordinarily found as well as the thrill of discovery of a real diamond. Additionally, one may observe the appearance of a rough, uncut diamond and compare it with the more familiar gem-like quality of the cut diamond. In short, the game is both recreational and educational in nature.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A game in the form of a quantity of granular material within which is concealed an item of value comprising: a hexagonal display container with side walls having means defining an aperture in at least one side wall thereof whereby interior contents may be viewed; a pair of opposed pillows blocks in said container at the top and bottom thereof, respectively, each of said pillow blocks having external lateral dimensions approximating the interior lateral dimensions of said container; a hexagonal box having side walls disposed between said pillow blocks, said box being configured similarly to said container but having smaller dimensions; at least one of said box side walls being transparent to permit viewing of the interior thereof; and a quantity of granular material within said box, within which there is said single item of value, said single item of value being of a size and shape sufficiently similar to at least a portion of said granular material so as to require careful examination and comparison of size and shape by a user of said game to distinguish said item of value from said portion of said granular material.

2. The game as claimed in claim 1 wherein said container has at least two opposed side walls having apertures therein, each aperture being formed by an "I" configured cut through said side wall, cut portions of said side wall formed by said aperture being retained in folded disposition by said box side walls when said box, container and pillow blocks are assembled together.

3. The game as claimed in claim 1 wherein said each pillow block further comprises means defining a recess cutout therein having interior lateral dimensions approximating the external lateral dimensions of said box to thereby firmly retain said box within said container in assembled relationship.

4. The game as recited in claim 1 wherein both said container and said box are cube shaped, a diagonal of a side of said box having substantially the same dimensions as an edge of said container, said box being angularly disposed in said container in assembly by having said box diagonal positioned parallel to one of said container edges.

5. The game as claimed in claim 1, said box further comprising a flexible, transparent container of plastics material for retaining said quantity of granular material in said box.

6. The game as recited in claim 1 further comprising a hexagonal specimen box having a bottom and a top, said box being used for display of the item of value after is it found, said top of said specimen box further comprising magnifying glass means formed integrally therein for assisting in the search for the item of value within said quantity of granular material.

* * * * *